US009540143B2

(12) United States Patent
Roberge et al.

(10) Patent No.: US 9,540,143 B2
(45) Date of Patent: Jan. 10, 2017

(54) POULTRY TRAY AND METHOD OF PACKAGING POULTRY USING SAME

(71) Applicant: CASCADES CANADA ULC, Montreal (CA)

(72) Inventors: Mathieu Roberge, Danville (CA); Philippe Marcoux, Drummondville (CA); Serge Blais, Drummondville (CA); Simon Bédard, Drummondville (CA)

(73) Assignee: CASCADES CANADA ULC, Montreal, Quebec (CA)

( * ) Notice: Subject to any disclaimer, the term of this patent is extended or adjusted under 35 U.S.C. 154(b) by 120 days.

(21) Appl. No.: 14/509,748

(22) Filed: Oct. 8, 2014

(65) Prior Publication Data

US 2015/0096915 A1 Apr. 9, 2015

Related U.S. Application Data

(60) Provisional application No. 61/888,152, filed on Oct. 8, 2013.

(51) Int. Cl.

| | |
|---|---|
| ***B65D 1/34*** | (2006.01) |
| ***B65D 6/04*** | (2006.01) |
| ***B65D 25/10*** | (2006.01) |
| *B65B 25/06* | (2006.01) |

(52) U.S. Cl.

CPC ..... *B65D 25/10* (2013.01); *B65D 1/34* (2013.01); *B65B 25/064* (2013.01)

(58) Field of Classification Search

CPC ..... B65D 25/10; B65D 1/34; B65D 1/46; B65B 25/064

USPC ..... 206/557, 564, 563, 471, 467; 229/406, 229/407, 902, 905; 426/112, 129

See application file for complete search history.

(56) References Cited

U.S. PATENT DOCUMENTS

| | | | | |
|---|---|---|---|---|
| 2,536,639 | A | 1/1951 | Guyer | |
| 2,814,381 | A | 11/1957 | Stevick | |
| 3,756,492 | A | 9/1973 | Reifers et al. | |
| 4,058,247 | A | 11/1977 | Florian | |
| 4,173,655 | A | 11/1979 | Capo | |
| 4,899,925 | A | 2/1990 | Bowden et al. | |
| 5,558,222 | A | 9/1996 | Volk et al. | |
| 6,016,744 | A | 1/2000 | Pritsker | |
| 6,871,742 | B1 * | 3/2005 | Paik | A47F 7/14 206/449 |
| 7,007,837 | B2 | 3/2006 | Correll | |

(Continued)

FOREIGN PATENT DOCUMENTS

| | | | |
|---|---|---|---|
| EP | 1262411 | A1 | 12/2002 |
| GB | 2307225 | A | 5/1997 |
| WO | 0064759 | A1 | 11/2000 |

*Primary Examiner* — Jacob K Ackun
*Assistant Examiner* — Rafael Ortiz
(74) *Attorney, Agent, or Firm* — Sutherland Asbill & Brennan LLP

(57) ABSTRACT

A poultry tray for shipping and displaying a dressed poultry. The poultry tray comprises a receptacle including a bottom wall and a peripheral wall having an upper end defining a receptacle opening. The poultry tray also comprises a flap pivotally connected to the receptacle at a rear end thereof. The flap is pivotable between an open configuration wherein the flap extends outwardly from the receptacle opening and a closed configuration wherein the flap covers a section of the receptacle opening and has a distal end detachably secured to the receptacle.

20 Claims, 6 Drawing Sheets

(56) References Cited

U.S. PATENT DOCUMENTS

| | | | | |
|---|---|---|---|---|
| 7,381,437 | B2 | 6/2008 | Brander | |
| 8,357,414 | B2 | 1/2013 | Becraft | |
| 2012/0160792 | A1* | 6/2012 | Kim | G01N 33/54366 211/71.01 |

* cited by examiner

POULTRY TRAY AND METHOD OF PACKAGING POULTRY USING SAME

CROSS-REFERENCE TO RELATED APPLICATIONS

This application claims priority under 35USC §119(e) of US provisional patent application No. 61/888.152 filed on Oct. 8, 2013, the specification of which is hereby incorporated by reference.

FIELD OF THE INVENTION

The present invention relates to the field of alimentary product packaging. More particularly, it relates to a poultry tray for receiving, transporting, and displaying poultry.

BACKGROUND

Many types of packages and containers are known in the art for receiving raw alimentary products (or food products) to be placed therein for transport and/or display to consumers for sale. In many cases, these containers are not specifically designed for a particular type of alimentary product and can receive therein a variety of products such as, for example, red meat, fish, poultry or the like. In such cases, it is known to provide a centrally located raised portion in the bottom wall of the container, such as to create an uplifting of the product and a tighter stretching of the overwrap over the exposed surface thereof, in order to produce an improved aesthetic appearance of the alimentary product.

The above-mentioned containers are however of generic construction and are consequently not designed for uplifting specific portions of a particular product.

Regarding specifically poultry, given the particular shape of the body of fowls, some poultry trays have been developed explicitly to suitably maintain and present dressed poultry to consumers, for example in open refrigerators commonly found in supermarkets. Such containers offer different solutions for preventing shifting of the fowl within the tray and to maintain the legs of the fowl in proper position. In many cases, known solutions to maintain the legs of the fowl in proper position do not provide easy shifting between a closed configuration where the legs are maintained inside the container and an open configuration where the legs are free. Consequently, in many cases, the configuration of a leg support for maintaining the legs of the fowl in proper position does not allow the legs of the fowl to be positioned inside the container and to be maintained therein by the subsequent connection of the leg support with the container.

In view of the above, there is a need for an improved poultry container which, by virtue of its design and components, would be able to overcome or at least minimize some of the above-discussed prior art concerns.

SUMMARY OF THE INVENTION

According to a general aspect, there is provided a poultry tray for shipping and displaying a dressed poultry. The poultry tray comprises: a receptacle including a bottom wall and a peripheral wall having an upper end defining a receptacle opening; and a flap pivotally connected to the receptacle at a rear end thereof, the flap being pivotable between an open configuration wherein the flap extends outwardly from the receptacle opening and a closed configuration wherein the flap covers a section of the receptacle opening and has a distal end securable to the receptacle.

In an embodiment, the distal end of the flap is detachably secured to the receptacle in the closed configuration.

In an embodiment, the flap comprises one of a male attachment member and a female attachment member, complementary with the male attachment member, and the receptacle comprises the other one of the male attachment member and the female attachment member, the complimentary male and female attachment members being detachably engageable to one another. A distance along a transversal axis of the receptacle between the one of the male attachment member and the female attachment member of the flap can be greater than a distance between the other one of the male attachment member and the female attachment member of the receptacle. The ones of the male members and the female members provided on the receptacle can be spaced apart from one another along the transversal axis, each one of the ones of the male members and the female members being provided close to a respective one of a longitudinal section of the peripheral wall. The bottom wall can comprise a supporting surface and at least one raised section, extending above the supporting surface, configured to expose prominently a specific part of the dressed poultry. The at least one raised section can comprise a poultry breast raised section extending inwardly and centrally from a front end of the receptacle and towards the rear end, the poultry breast raised section having an upper surface extending above the supporting surface, the poultry breast raised section being configured to highlight the breast of the poultry. The upper surface of the poultry breast raised section can be beveled towards the front end of the receptacle. The at least one raised section can comprise two poultry thigh raised sections, each one of the poultry thigh raised sections being configured to highlight a corresponding poultry thigh, each one of the poultry thigh raised sections being adjacent to the peripheral wall close to the rear end, and extending above the supporting surface. The poultry thigh raised sections can be spaced apart from one another along a transversal axis of the receptacle and each one of the poultry thigh raised sections comprises at least one of a male member and a female member and the flap comprises the other ones of the male members and the female members, the complementary male and female members being detachably engageable to one another. Each one of the poultry thigh raised sections can comprise an outer sub-section, adjacent to the rear end of the receptacle and an inner sub-section, adjacent to the outer sub-section and extending towards a front end of the receptacle along the peripheral wall, the outer sub-section having an upper surface extending above an upper surface of the inner sub-section, each one of the poultry thigh raised sections comprising an inner wall extending along the inner sub-section and a longitudinal axis of the receptacle, an upper edge of the inner wall extending above the upper surface of the inner sub-section of the poultry thigh raised sections. The upper edge of the inner wall can extend below the upper surface of the outer sub-section of the poultry thigh raised sections. Each one of the outer sub-sections of the poultry thigh raised sections can comprise the at least one of the male and the female members. The poultry thigh raised sections can extend below an upper end of the peripheral wall.

In an embodiment, the receptacle comprises a rim extending outwardly from the peripheral wall, close to an upper end thereof and the flap is pivotally mounted to the rim.

In an embodiment, the receptacle comprises a rim extending outwardly from the peripheral wall, close to an upper end thereof and a flange extending downwardly from an outer edge of the rim and the flap is pivotally mounted to the flange.

According to another general aspect, there is provided a method for packaging poultry using a poultry tray having a receptacle. The method comprises the steps of: configuring the poultry tray in an open configuration where a flap, pivotally connected to the receptacle, extends outwardly from a receptacle opening of the receptacle; inserting the poultry in the receptacle; pivoting the flap in a closed configuration where the flap covers a section of the receptacle opening at a rear end of the poultry tray including legs of the poultry; and securing the flap to the receptacle to maintain the flap in the closed configuration.

In an embodiment, inserting the poultry in the receptacle further comprises positioning the poultry such that the breast and the thighs of the poultry are respectively supported by a poultry breast raised section and poultry thigh raised sections of the receptacle, the poultry thigh raised sections and the poultry breast raised sections having an upper surface extending above a supporting section of a bottom wall of the receptacle.

In an embodiment, securing the flap to the receptacle to maintain the flap in the closed configuration comprises engaging complementary male members and female members of the flap and the receptacle.

BRIEF DESCRIPTION OF THE DRAWINGS

Other objects, advantages and features will become more apparent upon reading of the following non-restrictive description of embodiments thereof, given for the purpose of exemplification only, with reference to the accompanying drawings in which.

DETAILED DESCRIPTION

In the following description, the same numerical references refer to similar elements. The embodiments, geometrical configurations, materials mentioned and/or dimensions shown in the figures or described in the present description are embodiments only, given solely for exemplification purposes.

Moreover, although the embodiments of the poultry tray and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the poultry tray, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

Figure 2:
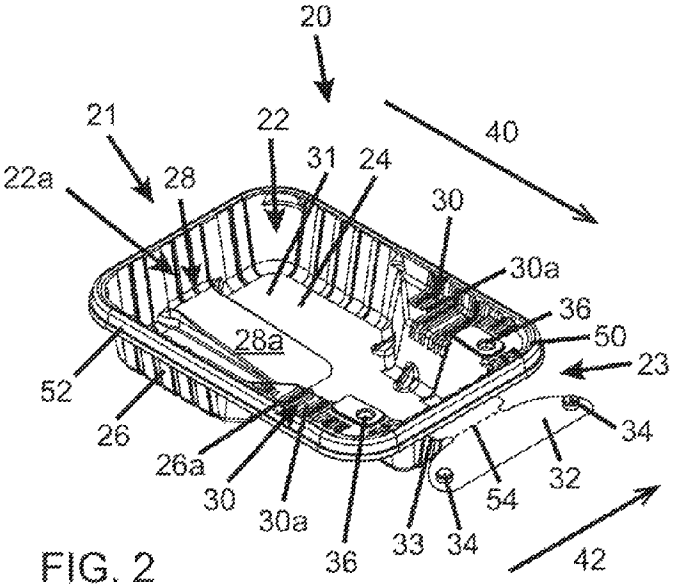
FIG. 2 is a top perspective view of the poultry tray of FIG. 1.
Figure 4:
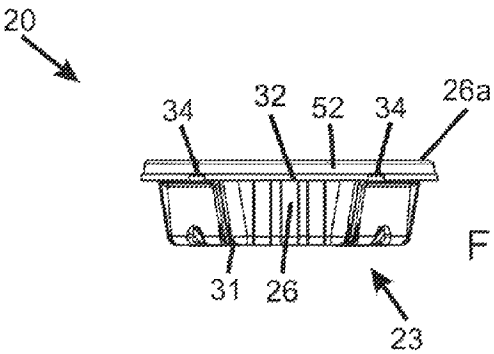
FIG. 4 is a rear elevation view of the poultry tray of FIG. 1.
Figure 1:
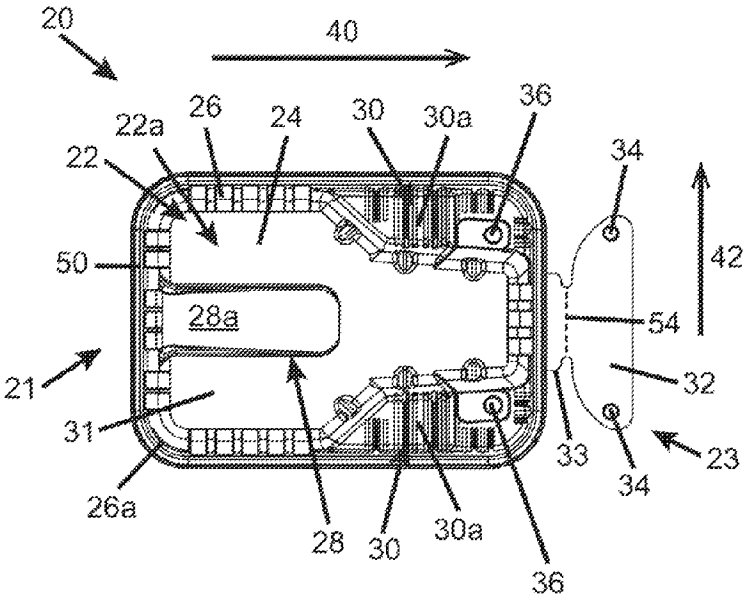
FIG. 1 is a top plan view of a poultry tray in accordance with an embodiment and shown in an open configuration.
Figure 3:
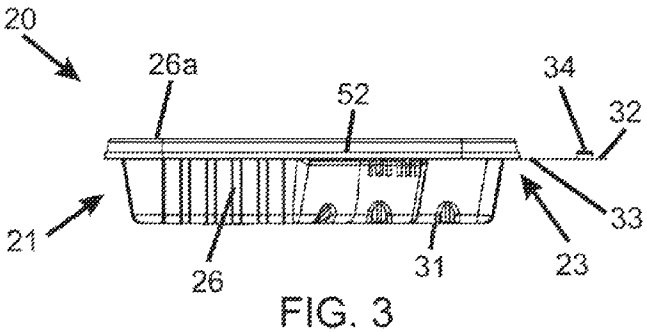
FIG. 3 is a side elevation view of the poultry tray of FIG. 1.
Figure 6:
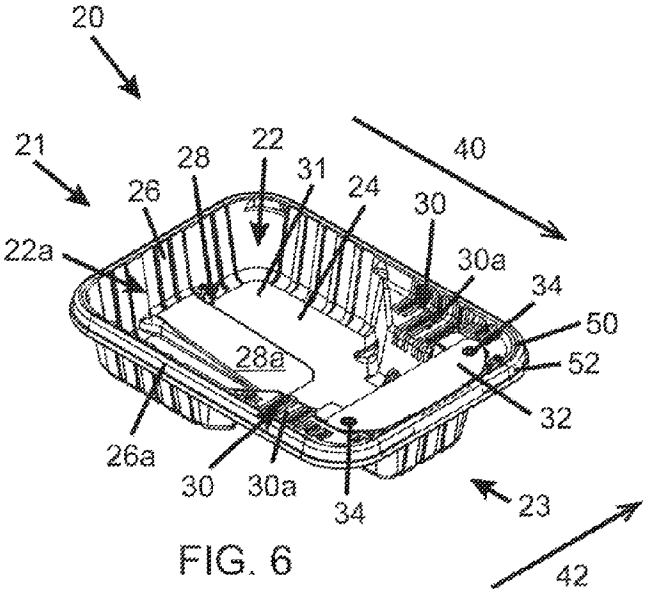
FIG. 6 is a top perspective view of the poultry tray of FIG. 5.
Figure 8:
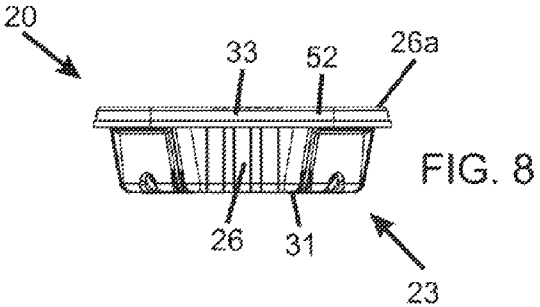
FIG. 8 is a rear elevation view of the poultry tray of FIG. 5.
Figure 5:
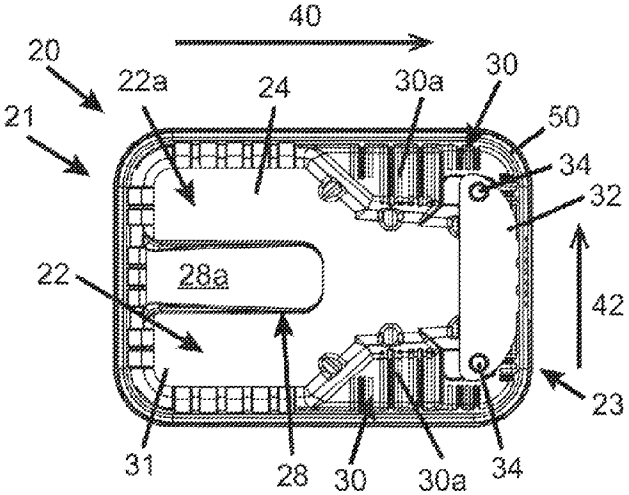
FIG. 5 is a top plan view of the poultry tray of FIG. 1, shown in a closed configuration.
Figure 7:
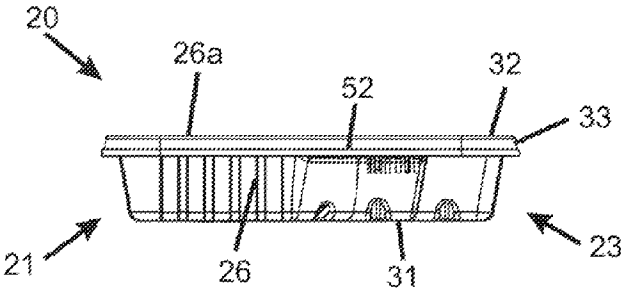
FIG. 7 is a side elevation view of the poultry tray of FIG. 5.

Referring generally to FIGS. 1 to 8, in accordance with one embodiment, there is provided a poultry tray 20 having a poultry receptacle 22 including a bottom wall 24 and a peripheral wall 26 extending upwardly therefrom and surrounding the bottom wall 24. The peripheral wall 26 has an upper end 26*a*, opposite the bottom wall 24, which defines a receptacle opening 22*a*. The peripheral wall has two spaced-apart longitudinal sections extending along a longitudinal axis 40 and two spaced-apart transversal sections, extending between the longitudinal sections and along a transversal axis 42, normal to the longitudinal axis 40. The poultry receptacle 22 is sized and shaped for receiving a poultry (not shown) therein.

In an embodiment, the bottom wall 24 includes raised sections 28, 30, extending upwardly into the receptacle 22 and configured to expose more prominently specific parts of a poultry contained in the poultry tray 20.

More particularly, in the embodiment shown, the bottom wall 24 includes a supporting section 31 and three raised sections 28, 30. The supporting section 31 supports the poultry tray 20 on a supporting surface, such as a shelf, a countertop, a table and the like, in a display configuration. The raised sections 28, 30 extend above the supporting section 31 with respect to the supporting surface, i.e. they are spaced-apart from one another along an axis substantially aligned with the peripheral wall 26. In this description, the poultry receptacle 22 will be defined as having a front end 21 and an opposed rear end 23. The front end 21 is configured to be adjacent to a breast of a poultry inserted in the receptacle 22 while the rear end 23 is configured to be adjacent to the thighs of the poultry when inserted in the receptacle 22.

In the illustrated embodiment, a poultry breast raised section 28 extends inwardly and centrally from the front end 21 of the tray 20 and is configured to highlight the breast of the poultry inserted in the receptacle 22. In the illustrated embodiment, an upper surface 28*a* of the poultry breast raised section 28 is beveled in order to facilitate the automatic placement of an absorbent (or soaker) pad (not shown). In the embodiment shown, the upper surface 28*a* is located below the upper end 26*a* of the peripheral wall 26 but above the supporting section 31 of the bottom wall 24. The upper surface 28*a* is beveled, being higher adjacent to the front end 21 than at an inner end, closer to the rear end 23. One skilled in the art will however understand that, in an alternative embodiment, poultry breast raised section 28 can have a substantially flat configuration, i.e. the upper surface 28*a* of the poultry breast raised section 28 can extend at a substantially constant distance from the upper end 26*a* of the peripheral wall 26, or above the supporting surface 32, along the longitudinal axis 40. In other words, the upper surface 28*a* of the poultry breast raised section 28 can extend substantially parallel to the supporting section 31 of the bottom wall 24.

In the illustrated embodiment, two poultry thigh raised sections 30 are also provided. The two poultry thigh raised sections 30 extend upwardly above the supporting section 31 but below the upper end 26*a* of the peripheral wall 26. They extend forwardly from the rear end 23 along the longitudinal axis 40. Each one of the poultry thigh raised sections 30 extend inwardly in the receptacle 22 from a corresponding one of a section of the peripheral wall 26 extending along the longitudinal axis 40. In the embodiment shown, from a top plan view (FIG. 1), each one of the poultry thigh raised sections 30 has a substantially trapezoidal shape with a beveled end, spaced-apart from the rear end 23. Each one of the poultry thigh raised sections 30 is configured to raise and highlight a corresponding poultry thigh. In the illustrated embodiment, each one of the poultry thigh raised sections 30 has an upper surface 30*a* upon which a poultry thigh can be rested. In the embodiment shown, the upper surface 30*a* of each poultry thigh raised section 30 extends higher than the upper surface 28*a* of the poultry breast raised section 28 and extends close to the upper end 26*a* of the peripheral wall 26. In the embodiment shown, the upper surfaces 28*a* of the poultry thigh raised sections 28 extend between the upper end 26*a* of the peripheral wall 26 and the supporting section 31 of the bottom wall 24. In the embodiment shown, the upper surfaces 28*a* extend substantially parallel to the supporting section 31 of the bottom wall 24.

One skilled in the art will understand that, in an alternative embodiment, the configuration and shape of the poultry breast raised section 28 and the poultry thigh raised sections 30 can vary from the embodiment shown. Moreover, in another alternative embodiment, the poultry tray 20 can be provided with only one of the poultry breast raised section 28 or the poultry thigh raised sections 30, each one of the poultry breast raised section 28 and the poultry thigh raised sections 30 being independent from one another. In the embodiment shown, the poultry breast raised section 28 extends between the two spaced-apart poultry thigh raised sections 30 along the transversal axis 42, extending substantially perpendicular to the longitudinal axis 40. Furthermore, an inner end of the poultry breast raised section 28 extends slightly past an inner end of the poultry thigh raised sections 30 along the longitudinal axis 40.

The receptacle 22 has a rim 50 extending outwardly from the upper end 26*a* of the peripheral wall 26. In the embodiment shown, the rim 50 surrounds the peripheral wall 26. A flange 52 extends downwardly from an outer side of the rim 50. As the rim 50, the flange 52 extends along a periphery of the receptacle 22.

The poultry tray 20 further includes an elongated flap 32 extending from a lower edge of the flange 52, along the transversal axis 42 of the tray 20. At a proximal end thereof, the flap 32 is pivotally connected to the tray 20 at the rear end 23, opposed from the front end 21 including the poultry breast raised section 28. In the illustrated embodiment, the flap 32 is hingedly connected to the lower edge of the flange 52 by a foldable connecting portion 33 acting like a hinge, such that the flap 32 is pivotable about the upper end 26*a* of the peripheral wall 26. In the embodiment shown, the foldable connecting portion 33 is connected to the flap 32 by a scored line 54 which facilitates folding of the flap 32 from an open configuration to a closed configuration, as will be described in more details below.

However, it will be understood that, in an alternative embodiment, the flap 32 can be connected to a section of the peripheral wall 26 other than the lower edge of the flange 52. It is appreciated that, in an alternative embodiment (not shown), the receptacle 22 can be free of rim 50 and, optionally, the downwardly extending flange 52. It is also appreciated that the flap 32 can be mounted to anyone of the peripheral wall 26, the upper end 26*a* of the peripheral wall 26, and/or the rim 50. Furthermore, other distinct assemblies and/or methods resulting in a pivotable connection between the flap 32 and the peripheral wall 26, the rim 50, or the flange 52 can be used. Moreover, it will be understood that even though the flap 32 is described and illustrated herein as a single component, in an alternative embodiment, the flap 32 can be made of two or more sections, each pivotally connected to the peripheral wall 26, the rim 50, or the flange 52 and collaborating with one another to retain the legs of the poultry, when configured in a closed configuration as will be described below.

Referring to FIGS. 1 to 4, the flap 32 can be configured in an open configuration where it extends outwardly from the receptacle opening 22*a* of the tray 20. In the illustrated embodiment, in the open configuration, the flap 32 extends substantially perpendicular to the peripheral wall 26 and parallel to the supporting section 31 of the bottom wall 24. However, one skilled in the art will understand that, in alternative embodiments, the flap 32 can be angled differently relative to the peripheral wall 26 without covering any portion of the receptacle opening 22*a*, when configured in the open configuration. In an alternative embodiment (not shown), the flap 32 can extend at least partially above the receptacle opening 22*a* in the open configuration.

Now referring to FIGS. 5 to 8, the flap 32 can be pivoted towards and above the receptacle 22*a*, in a closed configuration. In the closed configuration, it covers part of the receptacle opening 22*a* and thereby is configured to retain the ends of the poultry legs (not shown) inside a cavity of the receptacle 22. As can be seen in the illustrated embodiment, when the flap 32 is configured in the closed configuration, the foldable connecting portion 33 is folded onto the upper end 26*a* of the peripheral wall 26. In the closed configuration, the flap 32 is substantially aligned with or extends above the receptacle opening 22*a*. In the embodiment shown, a length of the flap 32 along the longitudinal axis 40, is shorter than a length of the poultry thigh raised sections 30 along the same axis 40. In the embodiment shown, a length of the flap 32 along the transversal axis 42 is shorter than a length of the receptacle along the same axis 42. In another embodiment, the length of the flap 32 along the transversal axis 42 can be longer than a length of the receptacle along the same axis 42.

In order to maintain the flap 32 in the closed configuration, the flap 32 and the receptacle 22 include complementary male and female members 34, 36 which allow the flap 32 to be detachably secured in the closed configuration. In the illustrated embodiment, two male members 34 are provided on the flap 32, at opposite ends thereof, and two complementary female members 36 are provided in the receptacle. More particularly, the male members 34 are provided close to a distal end of the flap 32, opposed to the proximal end, which is pivotally connected to the receptacle 22. The male members 34 are spaced apart from one another along the transversal axis 42. More particularly, each one of the male members 34 is associated to a respective one of the poultry thigh raised sections 30. Similarly, each one of the complementary female members 36 are spaced-apart from one another along the transversal axis 42. In the embodiment shown, the female members 32 are cavities defined in the upper surface 30*a* of each one of the poultry thigh raised sections 30. In an alternative embodiment, each one of the female members 36 can be associated to a respective one of the longitudinal sections of the peripheral wall 26. One skilled in the art will however understand that the male and female members can be inverted onto the flap 32 and the receptacle 22 and/or can be positioned differently along the flap 32 and the receptacle 22. For instance, in an alternative embodiment (not shown), the one of the complementary male and female members of the receptacle 22 can be defined in or provided on the rim 50. Moreover, in another alternative embodiment, an attachment mechanism different than the illustrated male and female members can be provided to supply the detachable connection between the flap 32 and the receptacle 22, when the flap 32 is configured in the closed configuration.

In another embodiment, the connection between the flap 32 and the receptacle 22 can be a permanent connection, i.e. one of the flap 32 and the receptacle 22 has to be cut to break the connection. For instance and without being limitative, the flap 32 can be plastic welded to the receptacle 22 when a poultry has been inserted in the receptacle 22 and the flap 32 has been configured in the closed configuration.

Figure 10:
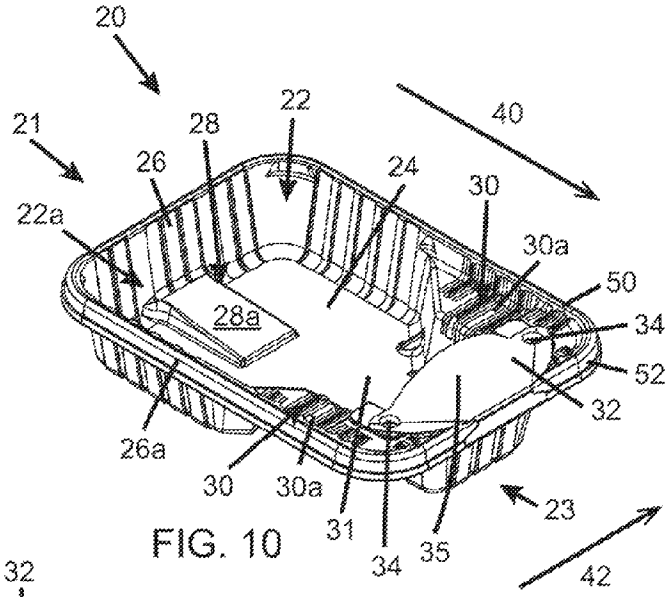
FIG. 10 is a top perspective view taken from a rear end of the poultry tray of FIG. 9.
Figure 9:
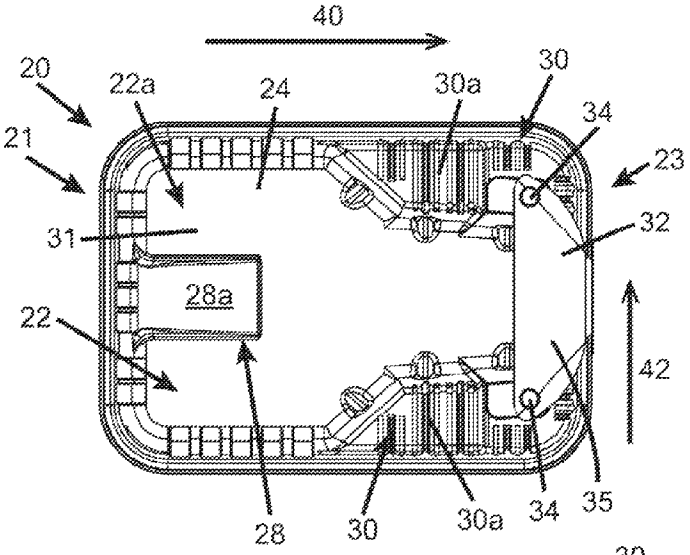
FIG. 9 is a top plan view of a poultry tray in accordance with an embodiment where a domed section is formed in a flap when the flap is configured in the closed configuration.
Figure 11:
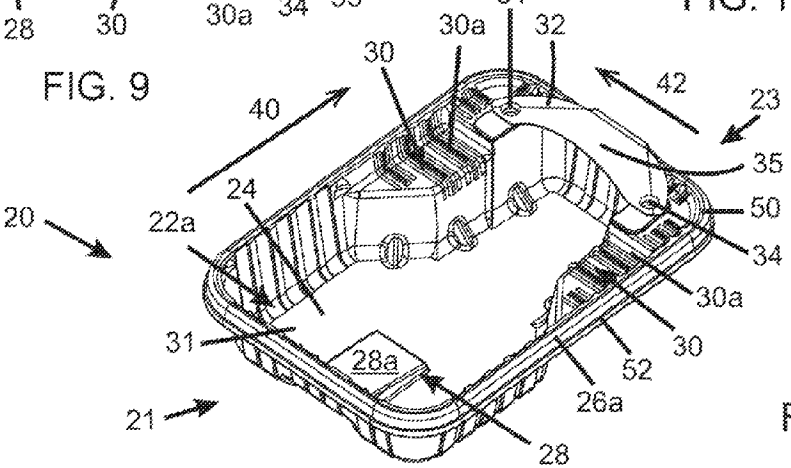
FIG. 11 is a top perspective view taken from a front end of the poultry tray of FIG. 9.
Figure 12:
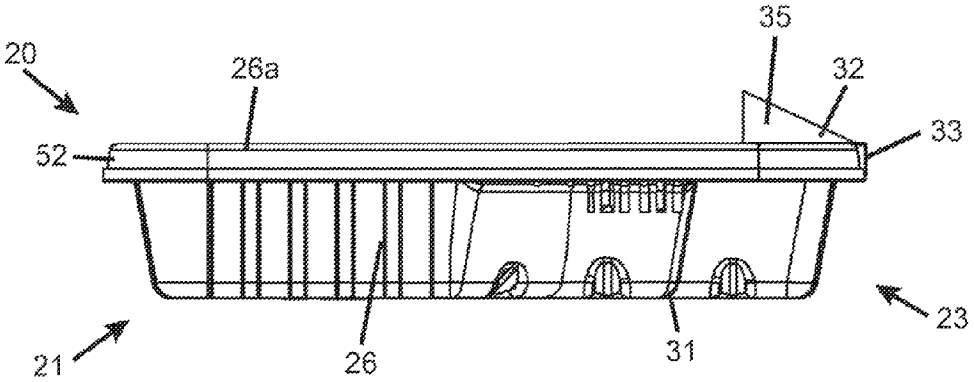
FIG. 12 is a side elevation view of the poultry tray of FIG. 9.
Figure 13:
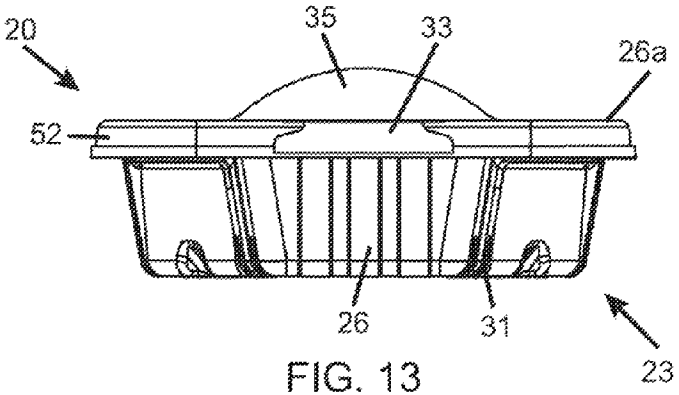
FIG. 13 is a rear elevation view of the poultry tray of FIG. 9.

Now referring to FIGS. 9 to 13, there is shown an alternative embodiment of the poultry tray 20 wherein the two male members 34 provided on the flap 32 are spaced apart of a distance that is greater than that of the two complementary female members 36 provided in the receptacle 22. Thus, in the open configuration, a distance between the male members 34 along the transversal axis 42 is longer than a distance between the female members 36 along the same axis 42. For example and without being limitative, in an embodiment, the distance between the two male members 34 provided on the flap 32 is approximately ¼ of inch greater than the distance between the two complementary female members 36.

One skilled in the art will again understand that the male and female members 34, 36 can be inverted onto the flap 32 and the receptacle 22. It is appreciated that if the flap 32 is provided with the male members of the complementary male and female member assembly, and the receptacle 22 is provided with the complementary female members, the distance between the male members of the flap 32 is greater than a distance between the female members of the receptacle 22.

In such an embodiment, the flap 32 is made of a flexible material. Therefore, when the flap 32 is configured in the closed configuration, the two male members 34 are contracted towards one another in order to engage the corresponding female members 36 and thereby create a domed section 35 in the flap 32. The domed section 35 created in the flap 32 helps maintain the male members 34 and the female members 36 connected to one another even when the tray 20 is deformed, for example during transport. Furthermore, the dome section 35 provides additional space to contain the poultry thighs. Similarly to the above described embodiment, when positioned in the closed configuration, the flap 32 comprising the domed section 35 still covers part of the receptacle opening 22*a* and thereby retains the ends of the poultry legs (not shown) therein.

Moreover, in an alternative embodiment, an attachment mechanism different than the illustrated male and female members can be provided to supply a detachable or permanent connection between the flap 32 and the receptacle 22 where a domed section 35 is formed when the flap 32 is configured in the closed configuration.

Furthermore, in the embodiment of the poultry tray 20 shown in FIGS. 9 to 13, the poultry breast raised section 28 is shorter than in the embodiment shown in FIGS. 1 to 8. More particularly, the inner end of the poultry breast raised section 28 is spaced apart from the inner end of the poultry thigh raised sections 30 along the longitudinal axis 40.

Figure 15:
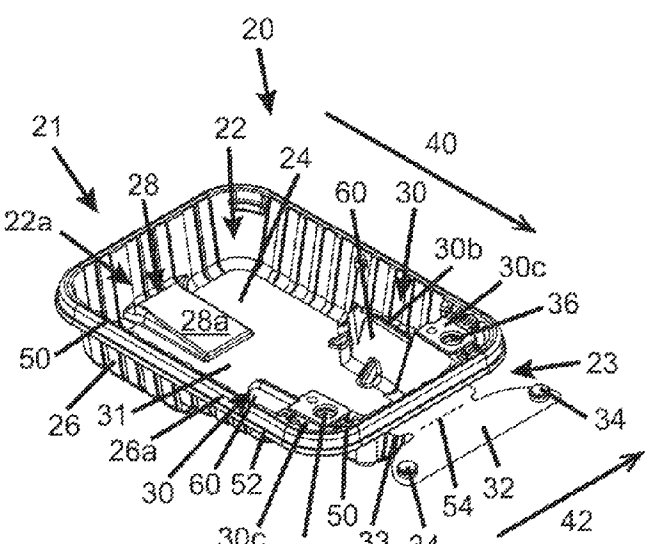
FIG. 15 is a top perspective view of the poultry tray of FIG. 14.
Figure 14:
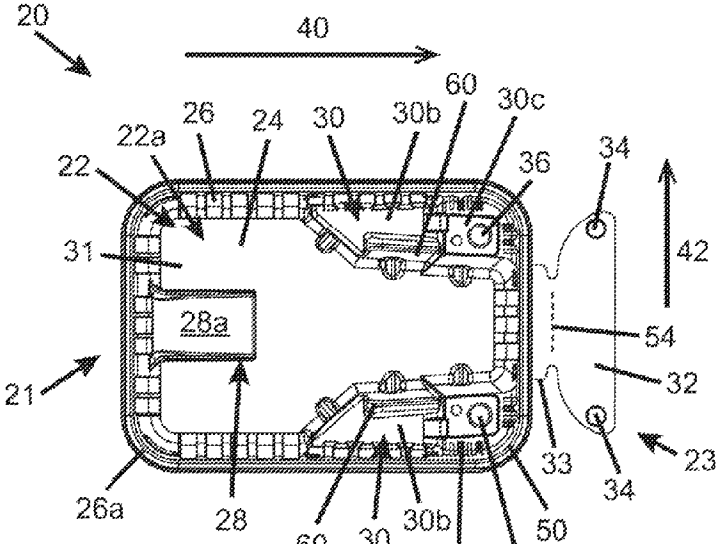
FIG. 14 is a top plan view of a poultry tray in accordance with another embodiment, with lower and narrower thigh raised sections and shown in an open configuration.
Figure 17:
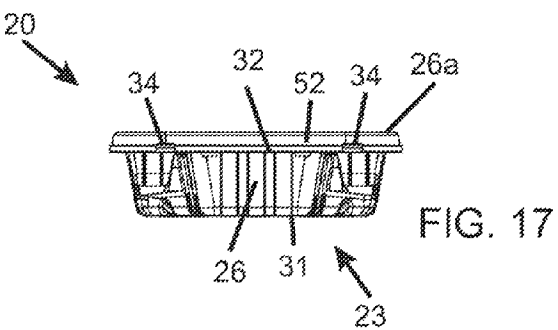
FIG. 17 is a rear elevation view of the poultry tray of FIG. 14.
Figure 16:
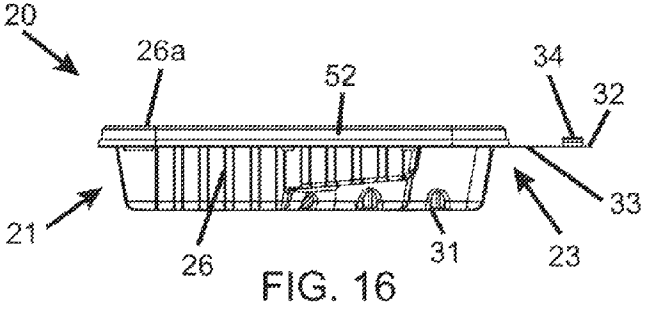
FIG. 16 is a side elevation view of the poultry tray of FIG. 14.
Figure 18:
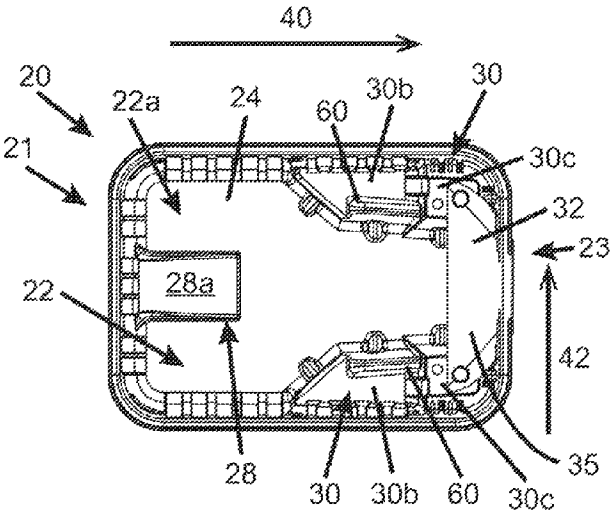
FIG. 18 is a top plan view of the poultry tray of FIG. 14, shown in a closed configuration.
Figure 19:
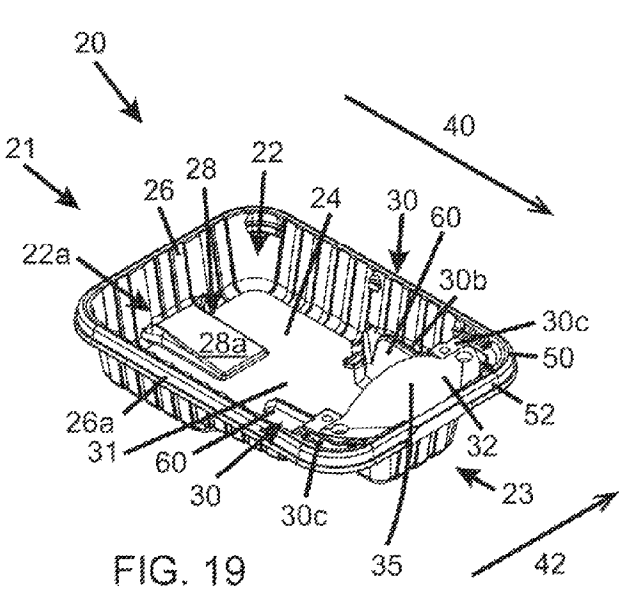
FIG. 19 is a top perspective view of the poultry tray of FIG. 18.
Figure 20:
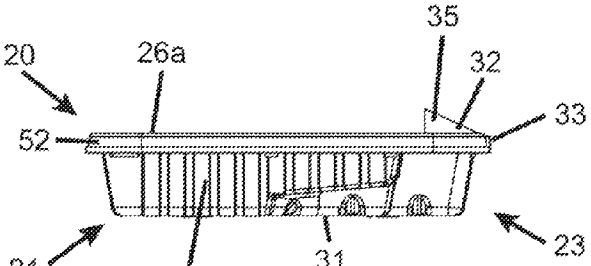
FIG. 20 is a side elevation view of the poultry tray of FIG. 18.
Figure 21:
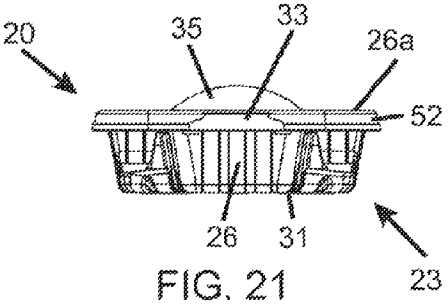
FIG. 21 is a rear elevation view of the poultry tray of FIG. 18.

Referring now to FIGS. 14 to 19, there is shown another embodiment of the poultry tray 20. As in the embodiment shown in FIGS. 9 to 13, the poultry breast raised section 28 is shorter than in the embodiment shown in FIGS. 1 to 8. More particularly, its inner end is spaced apart along the longitudinal axis 40 from an inner end of the poultry thigh raised section 30. Furthermore, as the poultry tray 20 shown in FIGS. 9 to 13, the flap 32 is provided with the dome section 35 when configured in the closed configuration.

Moreover, the poultry thigh raised sections 30 are different from the ones shown in FIGS. 1 to 13. More particularly, the poultry thigh raised sections 30 have two sub-sections 56, 58, each one being characterized by an upper surface at a different height with respect to the supporting section 31 of the bottom wall 24 and to the peripheral wall 26. The poultry thigh raised sections 30 have an inner sub-section 30*b* and an outer sub-section 30*c* with the outer sub-section 30*c* being closer to the rear end 23 of the receptacle 22 and the inner sub-section 30*b* extending inwardly from the outer sub-section 30*c* towards the front end 21 of the receptacle 22. The outer sub-section 30*c* extends above the inner sub-section 30*b* and includes the female member 36. The upper surface of the outer sub-section 30*c* extends below the upper end 36*a* of the peripheral wall 26. The inner sub-section 30*b* has an upper surface extending at a height between the supporting section 31 and the outer sub-section 30*c*. The inner sub-section 30*b* provides a longer continuous section of the peripheral wall 26, along the longitudinal axis 40 (from the front end 21 towards the rear end 23), which facilitates automatic handling of the poultry tray 20.

The inner sub-section 30*b* also includes an inner wall 60 extending upwardly from an inner edge thereof. The upper edge of the inner wall 60 extends above the upper substantially flat surface of the inner sub-section 30*b*, slightly below the upper surface of the outer sub-section 30*c*. In an alternative embodiment, the upper edge of the inner wall 60 can be substantially aligned with the upper surface of the outer sub-section 30*c*. The inner walls 60 are configured to substantially maintain the folded poultry thighs inside the poultry tray 20.

Referring to FIGS. 1 to 13, one skilled in the art will also understand that, in alternative embodiments, the shape of the flap 32, including the complementary male and female members 34, 36, can vary from the embodiment shown. It will also be understood that, in an alternative embodiment, the above-described flap 32 can be used in a poultry tray having at least one of the above described raised sections 28, 30 or being free of said raised sections 28, 30.

Furthermore, one skilled in the art will also appreciate that the shape and the configuration of the poultry thigh raised sections 30, the poultry breast raised section 28, the rim 50, and the flange 52 can vary from the embodiments shown. Similarly, the shape and configuration of the complementary male and female members 34, 36 can vary from the embodiments shown.

The poultry tray 20 according to an embodiment having been described above, a method for packaging poultry using the above-described poultry tray 20 will now be described. According to this method, the flap 32 is firstly configured in the above-described open configuration where the flap 32 extends away from the receptacle opening 22*a* and the male members 34 and female members 36 are consequently disengaged from one another. Subsequently, the poultry is inserted in the receptacle 22. In an embodiment where a poultry breast raised section 28 and poultry thigh raised sections 30 are provided, the poultry is positioned such that the breast and the thighs are respectively supported by the poultry breast raised section 28 and the poultry thigh raised sections 30. Once the poultry has been properly inserted in the receptacle 22, the flap 32 is pivoted into the closed configuration where the flap 32 covers a section of the receptacle opening 22*a*, at a rear 23 end of the receptacle 22 and the flap 32 is detachably secured to the receptacle 22. In an embodiment, the detachable securement of the flap 32 to the receptacle 22 is performed by engaging the corresponding male members 34 and female members 36 to one another. When secured in the closed configuration, the flap 32 covers the ends of the poultry legs and restrains the same from rising above the upper end 26*a* of the peripheral wall 26 of the tray 20.

Several alternative embodiments and examples have been described and illustrated herein. The embodiments of the invention described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while specific embodiments have been illustrated and described, numerous modifications come to mind without significantly departing from the scope of the invention as defined in the appended claims.

The invention claimed is:

1. A poultry tray for shipping and displaying a dressed poultry, the poultry tray comprising:

a receptacle including a bottom wall and a peripheral wall having an upper end defining a receptacle opening, the bottom wall comprises a supporting surface and two poultry thigh raised sections spaced apart from one another along a transversal axis of the receptacle, extending above the supporting surface and configured to highlight a corresponding poultry thigh, each one of the poultry thigh raised sections being adjacent to the peripheral wall close to a rear end and extending above the supporting surface; and a flap pivotally connected to the receptacle at the rear end thereof, the flap being pivotable between an open configuration wherein the flap extends outwardly from the receptacle opening and a closed configuration wherein the flap covers a section of the receptacle opening and has a distal end securable to the receptacle, wherein each one of the poultry thigh raised sections comprises at least one of a male member and a female member and the flap comprises at least two of the other one of the male member and the female member, the male and female members being complementary and detachably engageable to one another.

2. The poultry tray of claim 1, wherein the at least two of the ones of the male and female members provided on the flap are spaced apart from one another along a transversal axis of the receptable by a distance greater than a distance between the other one of the male members and the female members provided on the poultry thigh raised sections.

3. The poultry tray of claim 2, wherein the ones of the male members and the female members provided on the poultry thigh raised sections are spaced apart from one another along the transversal axis, each one being provided close to a respective one of a longitudinal section of the peripheral wall.

4. The poultry tray of claim 1, further comprising a poultry breast raised section extending inwardly and centrally from a front end of the receptacle and towards the rear end, the poultry breast raised section having an upper surface extending above the supporting surface, the poultry breast raised section being configured to highlight the breast of the poultry.

5. The poultry tray of claim 4, wherein the upper surface of the poultry breast raised section is beveled towards the front end of the receptacle.

6. The poultry tray of claim 1, wherein the poultry thigh raised sections are spaced apart from one another along a transversal axis of the receptacle and each one of the poultry thigh raised sections comprises at least one of a male member and a female member and the flap comprises the other ones of the male members and the female members, the complementary male and female members being detachably engageable to one another.

7. The poultry tray of claim 6, wherein each one of the poultry thigh raised sections comprises an outer sub-section, adjacent to the rear end of the receptacle and an inner sub-section, adjacent to the outer sub-section and extending towards a front end of the receptacle along the peripheral wall, the outer sub-section having an upper surface extending above an upper surface of the inner sub-section, each one of the poultry thigh raised sections comprising an inner wall extending along the inner sub-section and a longitudinal axis of the receptacle, an upper edge of the inner wall extending above the upper surface of the inner sub-section of the poultry thigh raised sections.

8. The poultry tray of claim 7, wherein the upper edge of the inner wall extends below the upper surface of the outer sub-section of the poultry thigh raised sections.

9. The poultry tray of claim 7, wherein each one of the outer sub-sections of the poultry thigh raised sections comprises the at least one of the male and the female members.

10. The poultry tray of claim 1, wherein the receptacle comprises a rim extending outwardly from the peripheral wall, close to an upper end thereof and the flap is pivotally mounted to the rim.

11. The poultry tray of claim 1, wherein the receptacle comprises a rim extending outwardly from the peripheral wall, close to an upper end thereof and a flange extending downwardly from an outer edge of the rim and the flap is pivotally mounted to the flange.

12. A method for packaging poultry, the method comprising the steps of:

providing a poultry tray as claimed in claim 1;

configuring the poultry tray in an open configuration where the flap extends outwardly from the receptacle opening of the receptacle;

inserting the poultry in the receptacle;

pivoting the flap in a closed configuration where the flap covers a section of the receptacle opening at the rear end of the poultry tray including legs of the poultry; and securing the flap to the receptacle to maintain the flap in the closed configuration by engaging the complementary male members and female members of the flap and the receptacle.

13. The method for packaging poultry of claim 12, wherein inserting the poultry in the receptacle further comprises positioning the poultry such that the breast and the thighs of the poultry are respectively supported by a poultry breast raised section and the poultry thigh raised sections of the receptacle, the poultry breast raised sections having an upper surface extending above the supporting surface of the bottom wall of the receptacle.

14. A poultry tray for shipping and displaying a dressed poultry, the poultry tray comprising:

a receptacle including a bottom wall and a peripheral wall having an upper end defining a receptacle opening, the bottom wall comprises a supporting surface and two poultry thigh raised sections, extending above the supporting surface and configured to highlight a corresponding poultry thigh, each one of the poultry thigh raised sections being adjacent to the peripheral wall close to a rear end and extending above the supporting surface and below an upper end of the peripheral wall; and a flap pivotally connected to the receptacle at the rear end thereof, the flap being pivotable between an open configuration wherein the flap extends outwardly from the receptacle opening and a closed configuration wherein the flap covers a section of the receptacle opening and has a distal end securable to the receptacle.

15. The poultry tray of claim 14, wherein the distal end of the flap is detachably secured to the receptacle in the closed configuration.

16. The poultry tray of claim 14, wherein the flap comprises one of male members and female members and the receptacle comprises the other one of the male members and the female members, the male and the female members being complementary and being detachably engageable to one another to secure the flap to the receptacle in the closed configuration.

17. The poultry tray of claim 16, wherein the flap comprises at least two of the one of the male members and the female members, spaced apart by a flap attachment distance along a transversal axis of the receptacle, the receptacle comprises at least two of the other one of the male members and the female members, spaced apart by a receptacle attachment distance along the transversal axis of the receptacle, the flap attachment distance being greater than the receptacle attachment distance.

18. The poultry tray of claim 17, wherein the ones of the male members and the female members provided on the receptacle are spaced apart from one another along the transversal axis, each one of the ones of the male members and the female members being provided close to a respective one of a longitudinal section of the peripheral wall.

19. The poultry tray of claim 14, further comprising a poultry breast raised section extending inwardly and centrally from a front end of the receptacle and towards the rear end, the poultry breast raised section having an upper surface extending above the supporting surface, the poultry breast raised section being configured to highlight the breast of the poultry.

20. The poultry tray of claim 19, wherein the upper surface of the poultry breast raised section is beveled towards the front end of the receptacle.

* * * * *